US006293785B1

(12) United States Patent
McGovern

(10) Patent No.: US 6,293,785 B1
(45) Date of Patent: Sep. 25, 2001

(54) FLEXIBLE TORCH OF ADJUSTABLE LENGTH

(76) Inventor: William J. McGovern, 8633 E. Davies Ave., Englewood, CO (US) 80112

( * ) Notice: Subject to any disclaimer, the term of this patent is extended or adjusted under 35 U.S.C. 154(b) by 0 days.

(21) Appl. No.: 09/520,819

(22) Filed: Mar. 8, 2000

(51) Int. Cl.[7] ..... F23D 14/46; F23D 14/28

(52) U.S. Cl. ..... 431/345; 431/344; 239/588; 239/587.4; 285/146.1

(58) Field of Search ..... 431/345, 344, 431/354, 355; 239/290, 587.4, 587.3, 588, 600, 587.1; 285/261, 272, 321; 34/90, 97; 266/48, 62, 57

(56) References Cited

U.S. PATENT DOCUMENTS 1,087,006 * 2/1914 Fitzsimons ..... 239/587.4
1,222,319 * 4/1917 Mueller ..... 239/587.4
2,191,077 * 2/1940 Kehl ..... 239/587.4
3,994,674 * 11/1976 Baumann et al. ..... 431/344
5,032,015 * 7/1991 Christianson ..... 285/223
5,386,644 * 2/1995 Lawall et al. ..... 34/90
5,765,292 * 6/1998 Chan ..... 34/97

* cited by examiner

*Primary Examiner*—James C. Yeung
(74) *Attorney, Agent, or Firm*—Ramon L. Pizarro; Edwin H. Crabtree

(57) ABSTRACT

A gas torch that includes a connector end that has a first end, which has been adapted for receiving fuel and a second end. The second end of the connector end includes a pivoting connector that provides fluid communication through the connector end. The connector end attaches to a tip connector that includes a first end and a second end. The first end of the tip connector being adapted for receiving the neck portion, and the second end of the tip connector being adapted for receiving a torch nozzle.

12 Claims, 2 Drawing Sheets

FLEXIBLE TORCH OF ADJUSTABLE LENGTH

BACKGROUND OF THE INVENTION (a) Field of the Invention

This invention generally relates to a torch of the type used to weld, cut, or solder. More specifically, to a flexible torch made from segments that allow flexing of the torch to allow the user to adjust the length and contour of the reach of the torch.

(b) Discussion of Known Art

The need for a torch that can flex as well as become elongated has existed for some time. The approach at providing flexibility in a torch, however, has typically focused on the use of a flexible duct, such as ducts made from a metallic spiral duct. An example of such a device is taught in U.S. Pat. No. 1,516,655 to Wade. The Wade invention includes a pair of flexible ducts, one for carrying oxygen and one for carrying a fuel gas. The Wade device, solves problems associated with torches that were made from rigid components, namely that they were virtually useless in confined or difficult to reach places. However, the Wade device suffers from the limitation that it is of a fixed length. Because of its fixed length, the user may still encounter awkward situations where the user must curl up the body of the device to take up the excessive length.

Another example of a torch with a flexible body is found in U.S. Pat. No. 2,203,210 to Young. The Young invention teaches the use of a flexible nozzle, which suffers from the same limitations as the Wade device. The Young device is made in set lengths, making the nozzle particularly well suited for some applications, but awkward or even useless in other applications. Thus, the Young device is particularly well suited for applications where the nozzle will remain at a fixed distance from the work piece, but does not provide guidance for applications in which the user is likely to different lengths, or different stiffnesses in the neck or body of the torch.

The approach of providing a fixed length torch with a flexible section again appears in U.S. Pat. No. 5,849,243 to Cononie, which adds a rigid casing to the flexible torch to add versatility to the device. This arrangement allows the user to remove the casing to expose the flexible lines of the torch to allow use of the torch as a flexible torch, and allows the use of the casing along the flexible portion to allow the use of the torch much like other teaches which include a rigid body. A significant disadvantage of this arrangement is that the user is again limited to a fixed length device. Thus the length of the neck or flexible portion of the torch must be compromised to provide a length that is suitable for most applications found in the field.

Yet another torch that provides flexibility to its tip is shown in U.S. Design Pat. No. D320,726 to Gartin. The Gartin device provides flexibility to a central portion of the torch, but suffers from the same limitations as other known flexible torches.

Thus, a review of known art indicates that there is a need for a flexible torch of a length that can be adjusted in the field.

There remains a need for a torch with a body that can be modified to allow for quick adjustment and modification in the field.

There remains a need for a flexible, bendable torch that can be bent or turned without exhibiting a propensity to return to its unbent shape.

SUMMARY

It has been discovered that the problems left unanswered by known art can be solved by providing a torch that includes:

- a neck portion that includes at least two sections that are pivotally connected to one another;
- a connector end that has been adapted for receiving gas delivery at one end and adapted for accepting the neck portion on the other end; and
- a tip connector that has been adapted for receiving the neck portion at one end and adapted for receiving or attaching a nozzle on the other end.

According to a highly preferred embodiment of the invention, the neck portion consists of several connectors. In one example, the connectors consist of line sections similar to those sold under the trademark Loc-Line by the Lockwood Company of Portland Oregon. In this example, the connector end includes one section that has been adapted for receiving a standard feed line for gas, such as propane fuel. The other end of the connector end includes a connection that has been adapted for receiving a pivotable connector such as the Loc-Line brand of connector.

The tip connector includes a first end that has been adapted for accepting a pivotable connector such as the Loc-Line brand of connector, and a second end. The second end of the tip connector has been adapted for accepting a nozzle, such as a nozzle for brazing, cutting, or simply heating an area.

Thus it will be understood that the disclosed arrangement provides important new and useful results in that the length of the neck of the torch can be lengthened or shortened by simply adding or removing sections of pivotable connectors. Thus, the user may create a torch with a very long neck that can wrap around a large pipe or get into a very restricted area.

Also of importance is that the removability of the intermediate sections allows the user to further modify the torch by inserting various components between the connector end and the tip connector. For example, if a particular situation requires that the user add a section that includes a venturi type of device, or a connector with an external component that included specialized gripping, support, or illumination features, then the user would simply add this connector between the connector end and the tip connector.

Additionally, it is important to note that it is contemplated that the disclosed neck portion may be easily protected or sealed by simply adding a section of extendible, flexible sleeve of tubing over the connector sections. This would add insulation to the neck portion to prevent inadvertent, unprotected exposure of the neck section to flame from the tip. Also, the sleeve would serve to capture or contain any gas that could escape from between the joints or connections of the connector end, the neck section, and the tip connector.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
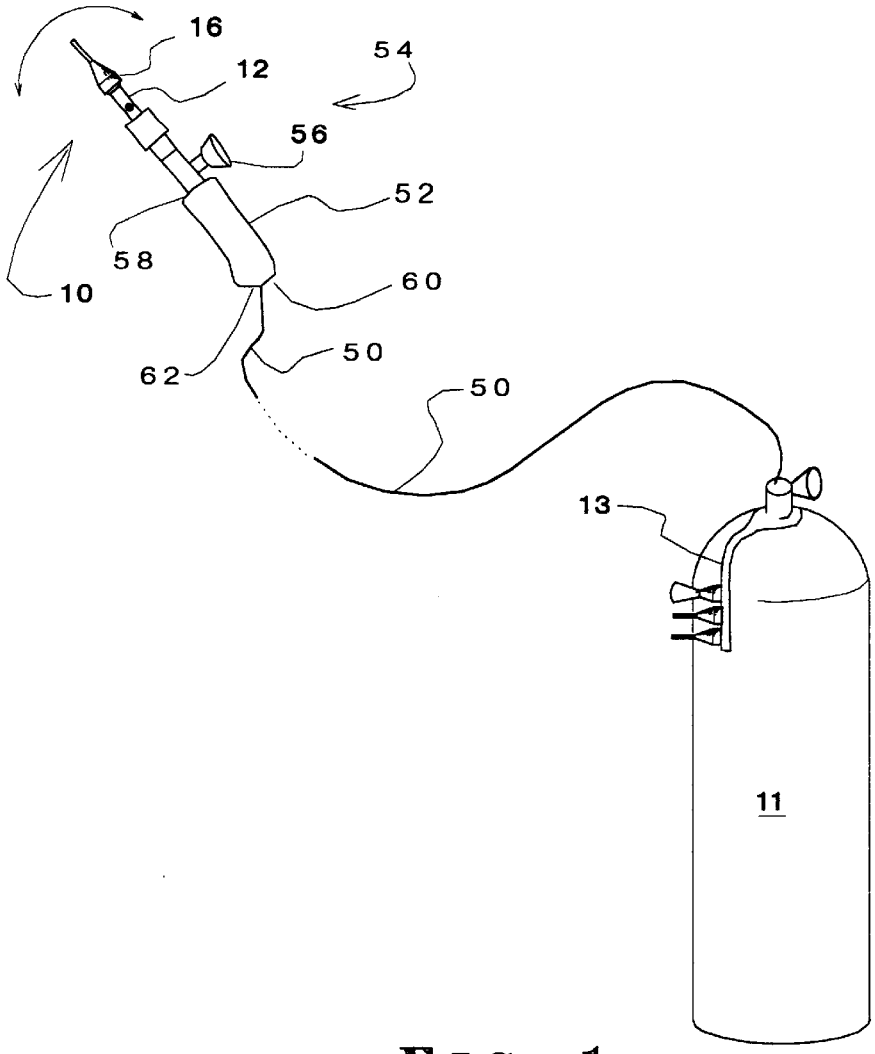
FIG. 1 is a perspective view of the disclosed invention attached to the gas output line on an acetylene tank by way of a quick disconnect mechanism.
Figure 6:
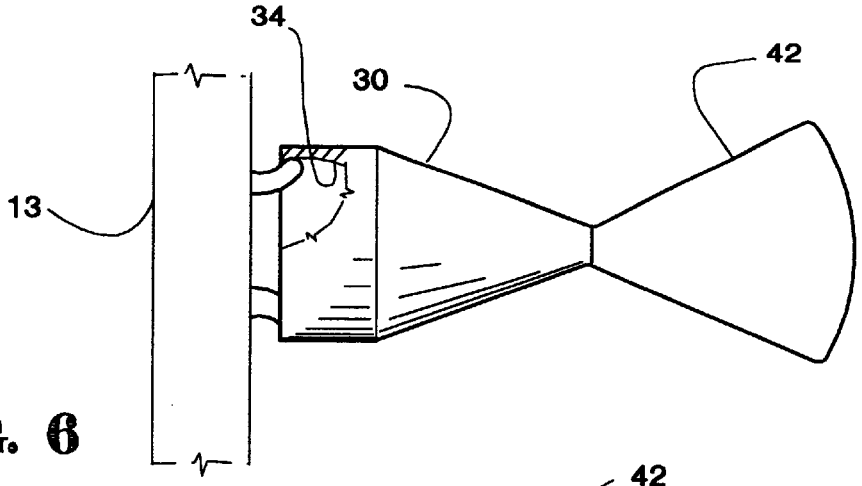
FIG. 6 illustrates the use of the invention with the tip connector support to hold a tip connector on the tank, for example.

FIG. 1 illustrates a gas torch 10, which is used with a fuel tank 11. The fuel tank 11 may be a fuel such as acetylene, which provides a flame that is particularly useful in plumbing operations. Mounted on the tank 11 is a tip connector support 13, shown in more detail in FIG. 6, which is user to hold spare or task specific tip connectors 16, like the tip connectors described herein. The fuel tank 11 serves as a fuel source, and includes a flexible hose or flexible fuel line 50 that delivers fuel to a handle 52 of a hand held gas torch 54. The handle including a gas delivery adjustment mechanism 56, which may be any sort of valve mechanism, a first end 58, a second end 60 and a connector 62 adapted for attaching the handle 52 to the flexible fuel line 50 leading to the fuel source or fuel tank 11.

Figure 2:
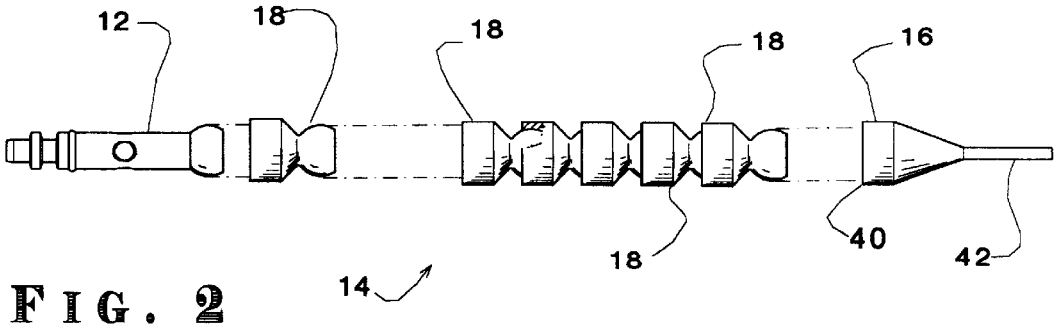
FIG. 2 is a side view of components used with the disclosed invention.

Turning now to FIG. 2 where the gas torch 10 made in accordance with the principles taught herein has been illustrated. In the illustrated example, the gas torch 10 includes a connector end 12, a neck portion 14, and a tip connector 16. It is contemplated that the connector end 12 may be pivotally mounted directly to the tip connector 16 to allow the tip connector 16 to pivot on the connector end 12. However, in a highly preferred embodiment of the invention, the neck portion 14 includes which includes at least one section 18 between the connector end 12 and the tip connector 16. The sections 18 provide a fluid passage from the connector end 12 to the tip connector 16. Each end to the sections 18 has been adapted for providing a pivotal connection between two similar sections 18. Therefore, it is important to keep in mind that the principles taught herein can be practiced by connecting the connector end 12 directly to the tip connector 16 as well as including a single section 18 between the connector end 12 and the tip connector 16. Additionally, that providing more than one section 18 will add to the flexibility of the torch as well as to the adjustability of the overall length of the neck portion 14, and hence the overall length of the torch 10. It is important to note that it is contemplated that a flexible, retractable sleeve may be incorporated in the connector end 12 or the tip connector 16. This sleeve could serve to provide fail-safe flow path that ensures that any leaks between the connector end 12 and the tip connector 16 are contained within the torch. Furthermore, this sleeve could be used over the torch to insulate sections of the torch when used in a manner that may cause some of the flame heat to be projected back to the torch between connector end 12 and the tip connector 16.

Figure 3:
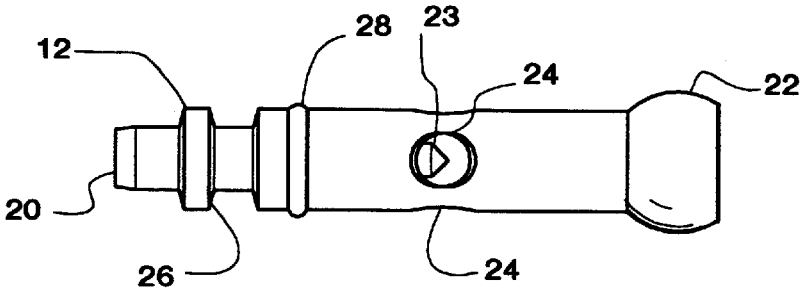
FIG. 3 is a side view of the connector end for use with the disclosed invention. The connector end also including the quick-disconnect features commonly found in attachments for use on gas or air hoses.

Turning now to FIG. 3 it will be understood that the connector end 12 includes a first end 20 and a second end 22. The first end 20 of the connector end 12 is adapted for accepting a quick disconnect connector of the type typically used to connect flexible gas lines to a torch. The gas received through the first end travels through a Venturi tip nozzle 23 that allows the creation of a pressure drop through the connector end 12 to draw air or oxygen trough several apertures 24 in the connector end 12. Thus the connector end 12 attaches to a hose or other fuel source, and allows the creation of a fuel and oxygen mixture that is then burned by the torch 10. Therefore, the engagement mechanism 26 has been shown including at least one O-ring 28 that is used prevent the escape of the fuel prior to creating the mixture. The second end 22 of the connector end 12 has been adapted for providing a pivoting connection with the neck portion 14. In a highly preferred embodiment of the invention this connection incorporates a generally spherical surface 30 that is engaged by the neck portion 14 to provide rotatable fluid communication between the connector end 12 and the neck portion.

Figure 4:
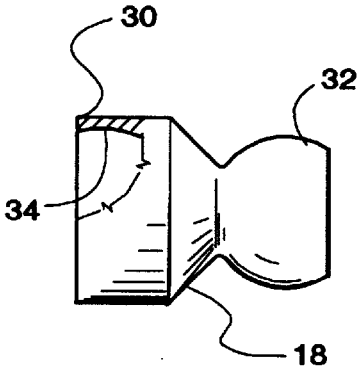
FIG. 4 is a side view of one of the sections of the neck portion.

As illustrated in FIG. 4, a preferred embodiment of the sections 18 are manufactured in a manner similar to Loc-Line brand sections that are commonly used to provide a fluid tight flexible duct for the transfer of fluids. A preferred embodiment of the neck portion 14 includes sections 18 that are substantially the same as one another, and preferably, similar to the Loc-Line brand of sections. Each of the sections 18 includes a skirt portion 30 and a spherical portion 32. The skirt portion 30 should include a cavity 34 that accepts and retains the spherical portion 32 of another section 18. Thus, it is advantageous to form the sections 18 from a resilient material of the sections 18 should be of a resin or other resilient material that allows the connection of one section 18 to another section 18.

Figure 5:
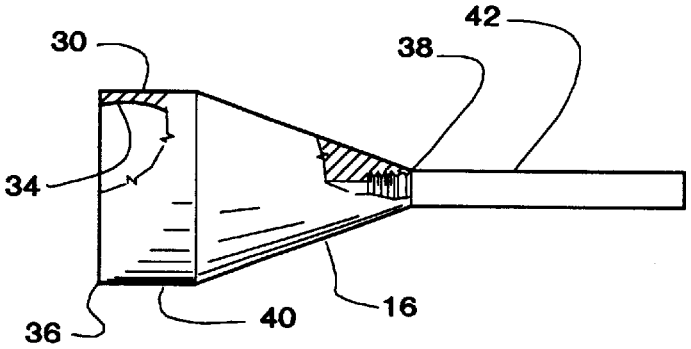
FIG. 5 is a side view of the tip connector with a torch tip attached.

Turning now to FIG. 5, it will be understood that the tip connector 16 will also include a first end 36 and a second end 38. The first end 36 of the tip connector 16 has been adapted for receiving the neck portion 14 or the connector end 12. The attachment to the neck portion 14 or the connector end 12 is accomplished, in the preferred embodiment, by incorporating a skirt portion 40, that is similar to the skirt portion 30 found in each of the sections 18. The second end 38 of the tip connector 16 has been adapted for receiving a torch nozzle 42, which is used to create the desired flow characteristics of a burning flame created with the torch 10.

Figure 7:
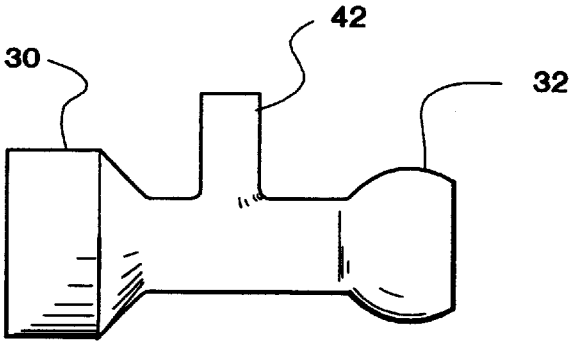
FIG. 7 illustrates a section that includes a torch nozzle between the two ends of the section.

To accept a variety of torch nozzles 42, the second end 38 of the tip connector 16 includes a threaded section or other connection mechanism that allows the mounting of the torch nozzle 42 to the tip connector 16. It is important to note, however, that it is contemplated that a variety of tip connectors 16 may be provided. Each tip connector 16 would have a specific shape or style of torch nozzle 42 to address the requirements of a specific job. Thus, it is contemplated that tip connector support 13 would be mounted against or along the tank 11. The tip connector support 13 would then allow the user to change or add sections to adjust or vary the flame created with the torch 10. Thus, if the user needed to crate a flame around a surface, the user could simply provide T-shaped connectors, similar to those shown on FIG. 7, with a skirt portion 30 on one end and a spherical or rounded connector or portion 32 on another end, and a torch nozzle 42 between the spherical portion and the skirt portion. This arrangement would allow the user to position several of these T-shaped connectors together to create a torch that can assume a rounded shape with the nozzles pointed radially inwards to heat a round tube, for example.

Accordingly, it will be understood that the second end 22 of the sections 18 or connector end 12 includes means for providing a pivotable union as a pivoting connector having a spherical or rounded surface that is accepted by a skirt or similar type section. Additionally, it is contemplated that each of the sections 18 may be made from a ceramic-coated polymer material that would resist chemical reactions with the fuel gas traveling through the torch or the inadvertent exposure of the sections to flame from the torch 10.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A hand held gas torch for welding cutting or brazing, the held torch comprising:

a handle, the handle having a gas delivery adjustment mechanism, a first end, a connector adapted for attaching the handle to a flexible fuel line leading to a fuel source;

a neck portion comprising at least one section that includes surfaces that allow more than one section to be pivotally connected to one another; a connector end having a first end and a second end, the first end of the connector end is adapted for attachment to the first end of the handle and for receiving gas delivery from the handle and the second end of the connector end being adapted for providing a pivoting connection with the neck portion; and a tip connector having a first end and a second end, the first end of the tip connector being adapted for receiving the neck portion, and the second end of the tip connector being adapted for receiving a torch nozzle.

2. A gas torch according to claim 1 wherein the second end of the connector end comprises a pivoting connector having a spherical surface.

3. A gas torch according to claim 2 wherein each of said sections of said neck portion are substantially the same as one another.

4. A gas torch according to claim 3 wherein said first end of said tip connector comprises a pivoting connector having a spherical surface.

5. A gas torch according to claim 1 wherein each of said sections is made from a ceramic coated polymer material.

6. A gas torch according to claim 1 wherein the handle, the connector end, said sections, and said tip connector are all pivotally connected to one another in series.

7. A method for articulating a flame nozzle on a hand held gas torch, the method comprising:

providing a hand held gas torch comprising:

a handle, the handle having a gas delivery adjustment mechanism, a first end, a connector adapted for attaching the handle to a flexible fuel line leading to a fuel source;

a hollow neck portion comprising at least one section having a first end and a second end, both the first end and the second end of the section having means for pivotally connecting and providing fluid communication of the section to another section;

a connector end having a first end and a second end, the first end of the connector end is adapted for attachment to the first end of the handle and for receiving gas delivery from the handle and the second end of the connector end being adapted for providing a pivoting connection with the neck portion; and a tip connector having a first end and a second end, the first end of the top connector being adapted for receiving the neck portion, and the second end of the tip connector being adapted for receiving a torch nozzle attaching the neck portion to the connector end and attaching the neck portion to the tip connector; and pivoting the tip connector relative to the neck portion to articulate the tip connector relation to the connector end.

8. A method according to claim 7 wherein the second end of the connector end comprises a pivoting connector having a spherical surface.

9. A method according to claim 7 wherein each of said sections of said neck portion is substantially the same as one another.

10. A method according to claim 7 wherein said first end of said tip connector comprises a pivoting connector having a spherical surface.

11. A method according to claim 7 wherein said section is made from a ceramic coated polymer material.

12. A method according to claim 7 wherein connector end, said sections, and said tip connector are all pivotally connected to one another in series.

* * * * *